United States Patent [19]

Pfeifer

[11] 4,295,330

[45] Oct. 20, 1981

[54] RE-ATTACHMENT DEVICE FOR AN OPEN-END TYPE SPINNING FRAME

[75] Inventor: Hermann Pfeifer, Geneva, Switzerland

[73] Assignee: Officine Savio, S.p.A., Pordenone, Italy

[21] Appl. No.: 162,502

[22] Filed: Jun. 24, 1980

[30] Foreign Application Priority Data

Jun. 26, 1979 [CH] Switzerland ..... 5936/79

[51] Int. Cl.[3] ..... D01H 15/02; B65H 54/26; B65H 67/08

[52] U.S. Cl. ..... 57/263; 242/35.5 A

[58] Field of Search ..... 57/58.89–58.95, 57/263, 269, 270, 261; 242/18 DD, 18 R, 18 A, 35.5 R, 35.5 A, 35.6 R, 35.6 E

[56] References Cited

U.S. PATENT DOCUMENTS

| | | | |
|---|---|---|---|
| 3,810,352 | 5/1974 | Miyazaki et al. | 57/263 |
| 3,940,076 | 2/1976 | Kato et al. | 242/18 R |
| 3,948,452 | 4/1976 | Burysek et al. | 242/35.5 A X |
| 3,962,855 | 6/1976 | Stahlecker | 57/263 |
| 4,107,957 | 8/1978 | Stahlecker et al. | 57/263 |
| 4,125,990 | 11/1978 | Stahlecker et al. | 57/263 |
| 4,150,532 | 4/1979 | Ligones | 57/263 |

FOREIGN PATENT DOCUMENTS 2370807 6/1978 France .

*Primary Examiner*—John Petrakes

*Attorney, Agent, or Firm*—Stevens, Davis, Miller & Mosher

[57] ABSTRACT

A device comprising a casing which bears two distinct hinged (articulated) systems, of which one is activated by jacks and includes four arms of which two are hinged together at one of their ends while another is hinged on the casing and on the free end of the arm, and the arm is hinged on the casing and at the middle of the arm that bears a roller to disengage the cop from the drive shaft.

The other system comprises two parallel arms hinged on an intermediate plate, two parallel arms hinged on the plate and on a support of the re-attachment head connected to a system of suction by means of a conduit and including two motors to drive in rotation a roller controlling the cop and to make its front part rotate by 180° in respect of its rear part.

In the re-attachment position the roller is employed to rotate a roller by friction located at the outlet of the turbine.

10 Claims, 13 Drawing Figures

FIG. 4
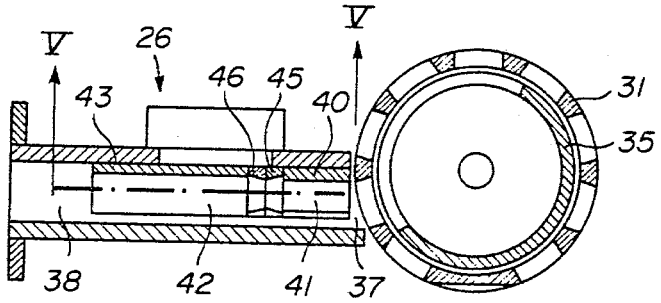
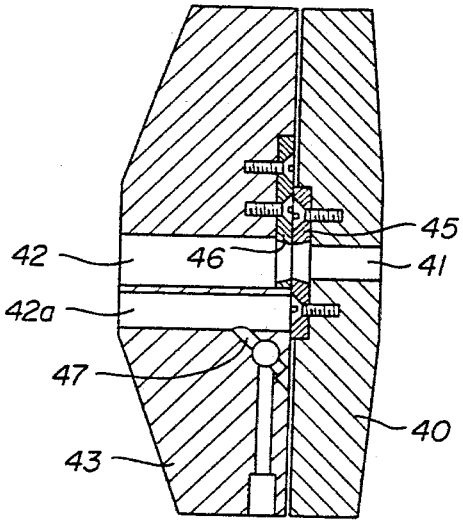
FIG. 5
FIG. 6
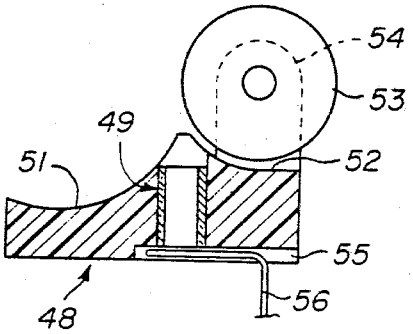

RE-ATTACHMENT DEVICE FOR AN OPEN-END TYPE SPINNING FRAME

This invention relates a re-attachment device for an open-end type spinning frame.

The problem of the automatic re-attachment of yarn produced by an open-end spinning frame has been the object of many studies, and many solutions to overcome the problem that exists. Such a device must be so reliable that it can carry out hundreds of re-attachments per day with almost one hundred percent success. Furthermore, it must work so quickly that it can provide a sure service for the greatest number of spinning stations possible. Lastly, its price must be compatible with its output.

Patent No. GB 1.247.234 set forth previously a solution to halt the yarn at the moment it breaks, to re-introduce it into the spinning rotor with a jet of air, to put some fibres into the same rotor at the same time so that the end of the broken yarn would link itself to the ring of fibres thus put into the rotor, and then to interrupt the jet of air so as to enable spinning to be started again by drawing the yarn from the rotor once more.

Such a simple solution involves two drawbacks; it does not permit the rotor to be cleaned nor does it enable a certain part of the yarn next to its cut end to be eliminated if it is deemed to be defective.

It is known that the yarn breaks owing to the buildup of impurities in the rotor and that yarn produced under such conditions is not of good quality. It is essential, therefore, that the actual re-attachment operation should enable the rotor to be cleaned and should envisage the elimination of a certain part of the yarn so that the re-attachment can be carried out with a part thereof which is of good quality.

This elimination of part of the yarn makes the reattachment device appreciably more complex. The elimination pre-supposes, in effect, that part of the yarn should be unwound from the cop and therefore that the cop should be disengaged from the drive shaft of the spinning frame and be rotated in the direction in which it is unwound.

The cutting of the yarn determines in general a transfer of the yarn itself and requires means able to grip the new end of the cut yarn so as to introduce it into the spinning rotor. The yarn does not only have to be introduced into the rotor, it also has to be drawn therefrom again in such a way that the part of it extracted can be definitely supplied to the extractor roller of the spinning frame.

The more complicated the device, the greater the difficulty involved in setting up these operations.

Various types of robots able to perform these different functions have been proposed. As in example reference is made to French. Pat. No. 2370807, which comprises an organ to disengage the cop from the drive shaft, a transmission to be engaged with the cop and the drive shaft so as to make the cop rotate in the direction in which the yarn is unwound, and a means for aspirating the end of the broken yarn. When the yarn has been chosen, it is transferred and positioned at the outlet of the spinning device with two operations, being picked up again, after being transferred, by means of a positioning and cutting organ.

Its introduction into the spinning device is brought about by a motive roller, which presses the yarn against the pressing roller of the machine after its disengagement from the shaft extracting the yarn.

Although the robot has given some promising results, it includes a relatively greater number of organs, which make it relatively more complicated and cause the re-attachment operations to be substantially more delicate during setting-up.

The essential purpose of the present invention, therefore, is the simplification of a re-attachment device for an open-end spinning frame so as to make it more reliable, faster and less expensive than the devices proposed in the present state of the art. With this end in view the device according to the invention comprises in conformity with the aforesaid Patent No. FR 2.370.807:

means to lift the cop from its drive shaft;

means to move the cop in the direction in which it is unwound;

a suction conduit to detach and aspirate the end of the yarn from the periphery of the cop, next to a roller installed so as to rotate around an axis lying crosswise to the inlet end of the conduit;

means to transfer the yarn between the cop and the pipe for the exit of the yarn from a spinning unit;

an organ to cut the yarn;

a pair of rollers connected to a pulling organ with a reversible direction of rotation to introduce the yarn into the rotor through the exit pipe for the yarn and to draw it back again as soon as it has been re-attached.

According to the invention the re-attachment device as indicated above is characterized by the fact that:

one of the rollers is installed in such a way as to rotate near the outlet of the pipe;

the other roller cooperates with the roller next to the suction conduit and is associated with the pulling organ;

the portion of the suction conduit next to the roller is installed so as to rotate around the lengthwise axis of the conduit;

a positioning organ connected to the portion by the suction conduit serves to move the portion between two angular positions lying at 180° to each other;

the organ to cut the yarn is fitted inside the suction organ;

the part of the suction conduit next to its rotating portion is solidly fixed to the transfer means connected in such a way as to move the roller from a first position next to the cop in one of the angular positions of the rotating position to a second position next to the roller fitted near to the outlet of the exit pipe for the yarn in the other angular position of the rotating position.

The attached tables show diagrammatically as an example a non-restrictive type of lay-out of the device which is the object of the invention.

FIG. 1 shows a side view of the device in a first position.

FIG. 2 gives a view like that of FIG. 1 but shows a second position of the device.

FIG. 3 gives a partial view of a detail obtained by sectioning FIG. 1 along the line III—III.

FIG. 4 gives the view of the section along the line IV—IV of FIG. 3.

FIG. 5 shows the view of the section along the line V—V of FIG. 4.

FIG. 6 shows a section from above of an enlarged detail of the spinning device.

Figure 8:
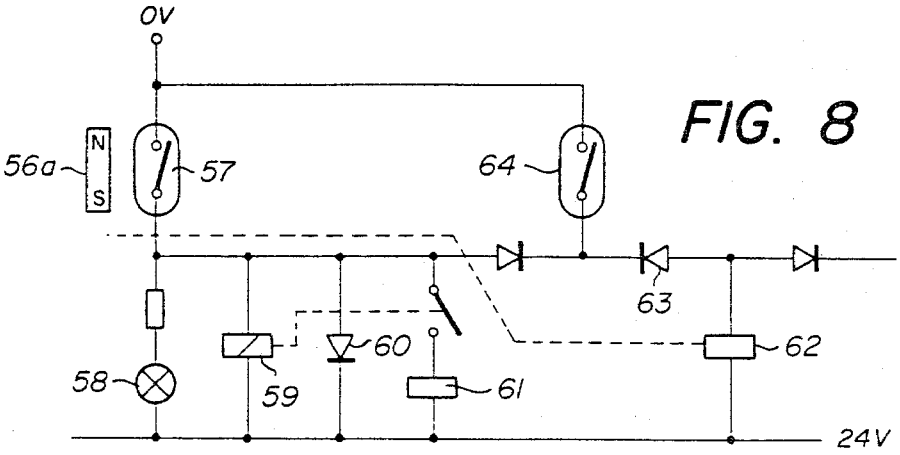

FIG. 8 gives an electrical diagram of the control circuit of the mechanism feeding the rotor for fibres.

Figure 9:
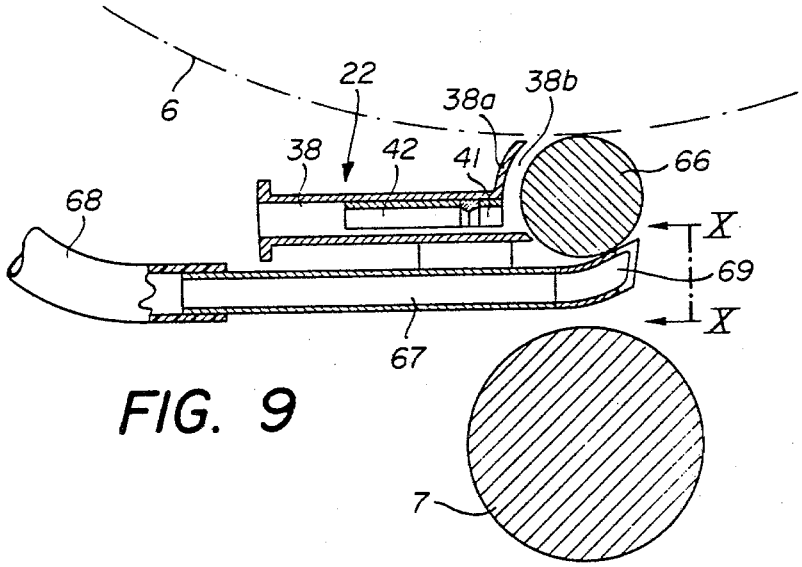

FIG. 9 is a section representing a variant of FIG. 4.

Figure 10:
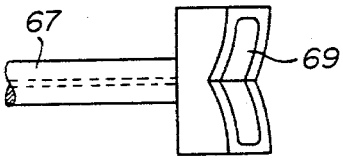

FIG. 10 is a view along X—X of FIG. 9.

Figure 11:
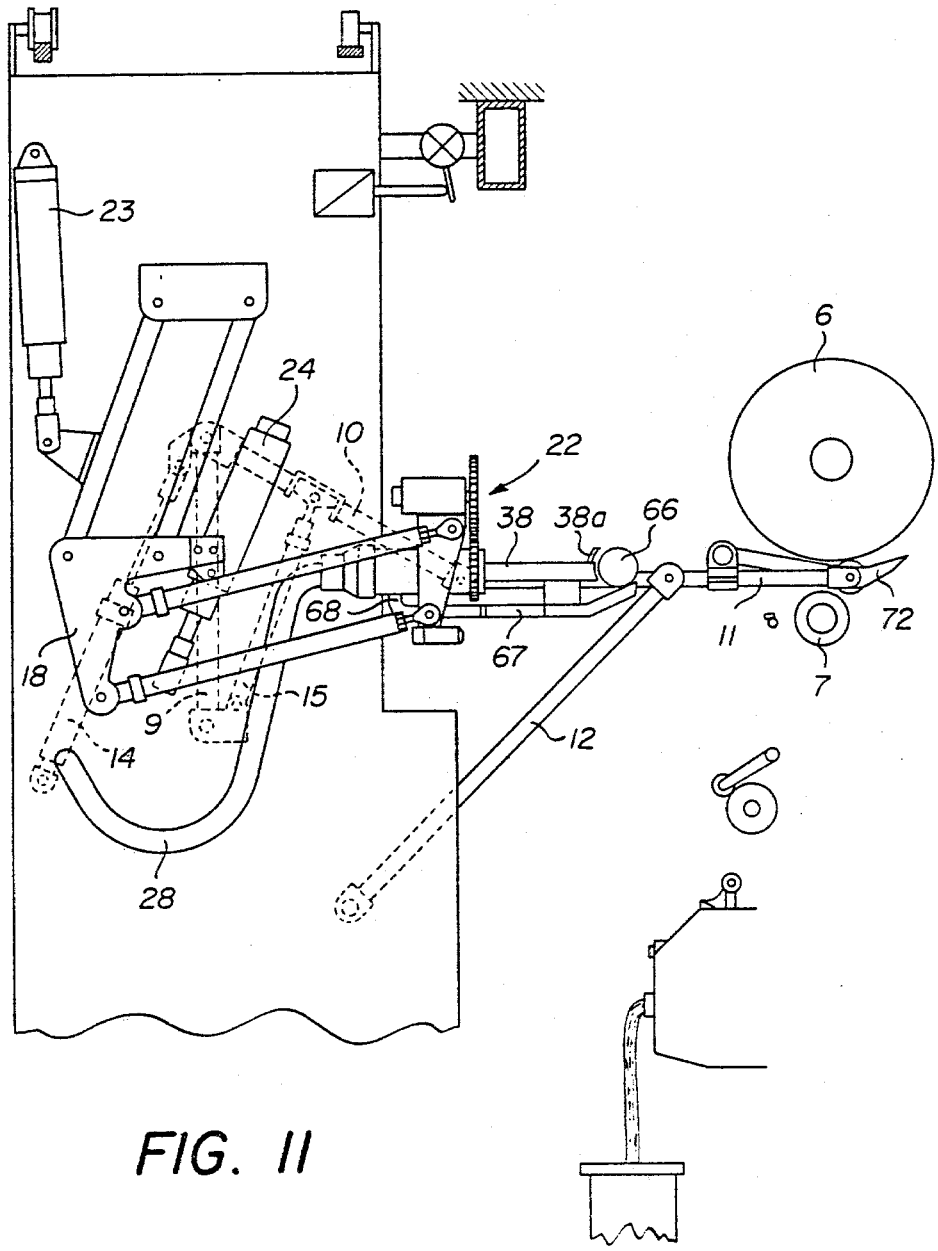

FIG. 11 is a side view of a variant of the device in an intermediate position.

Figure 12:
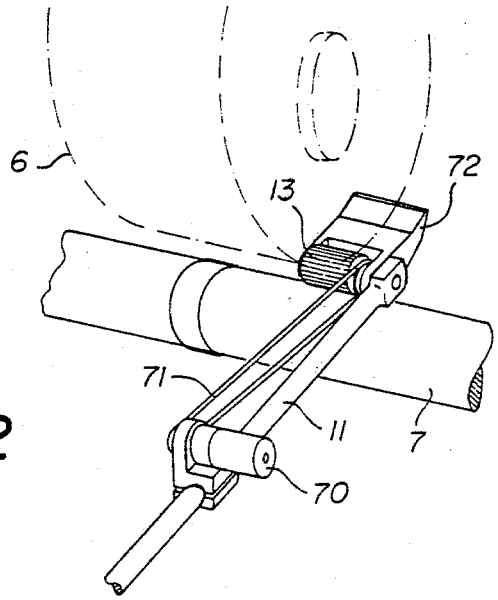

FIG. 12 is a view along the line XII—XII of a detail of FIG. 11.

Figure 13:
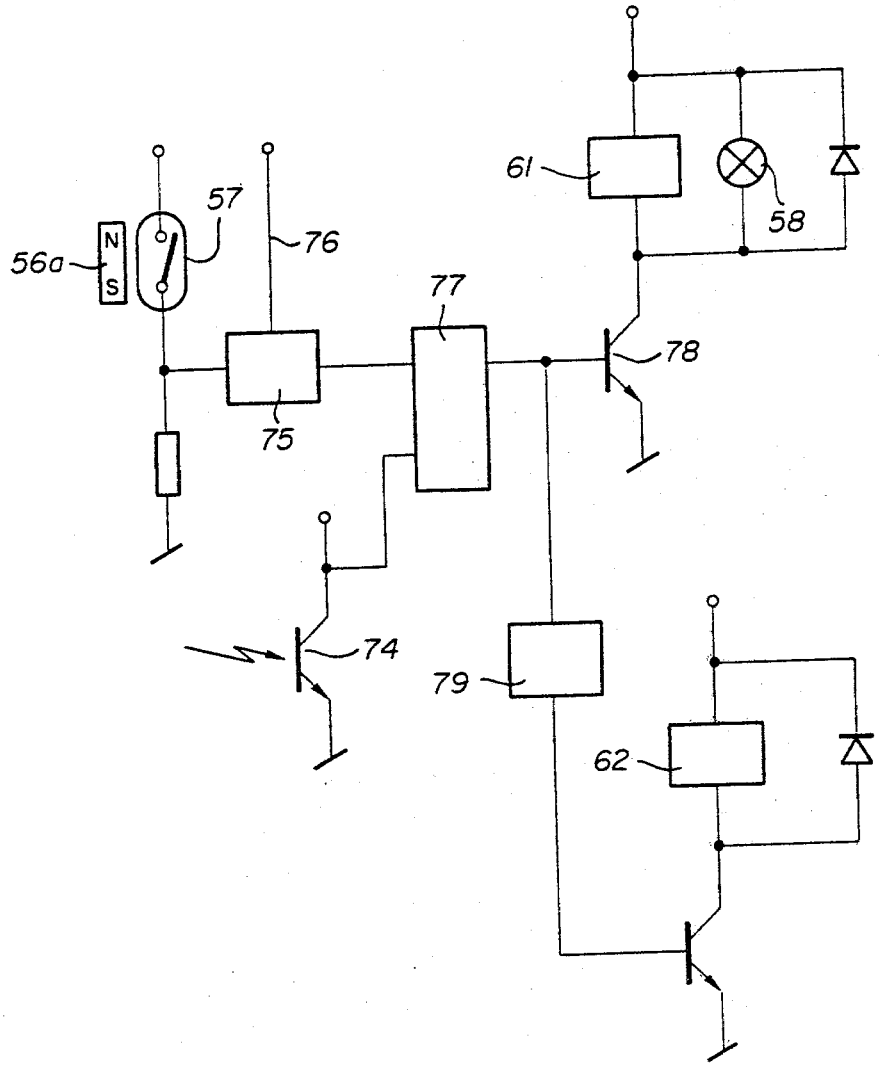

FIG. 13 is a variant by the electrical diagram of FIG. 8.

Figure 1:
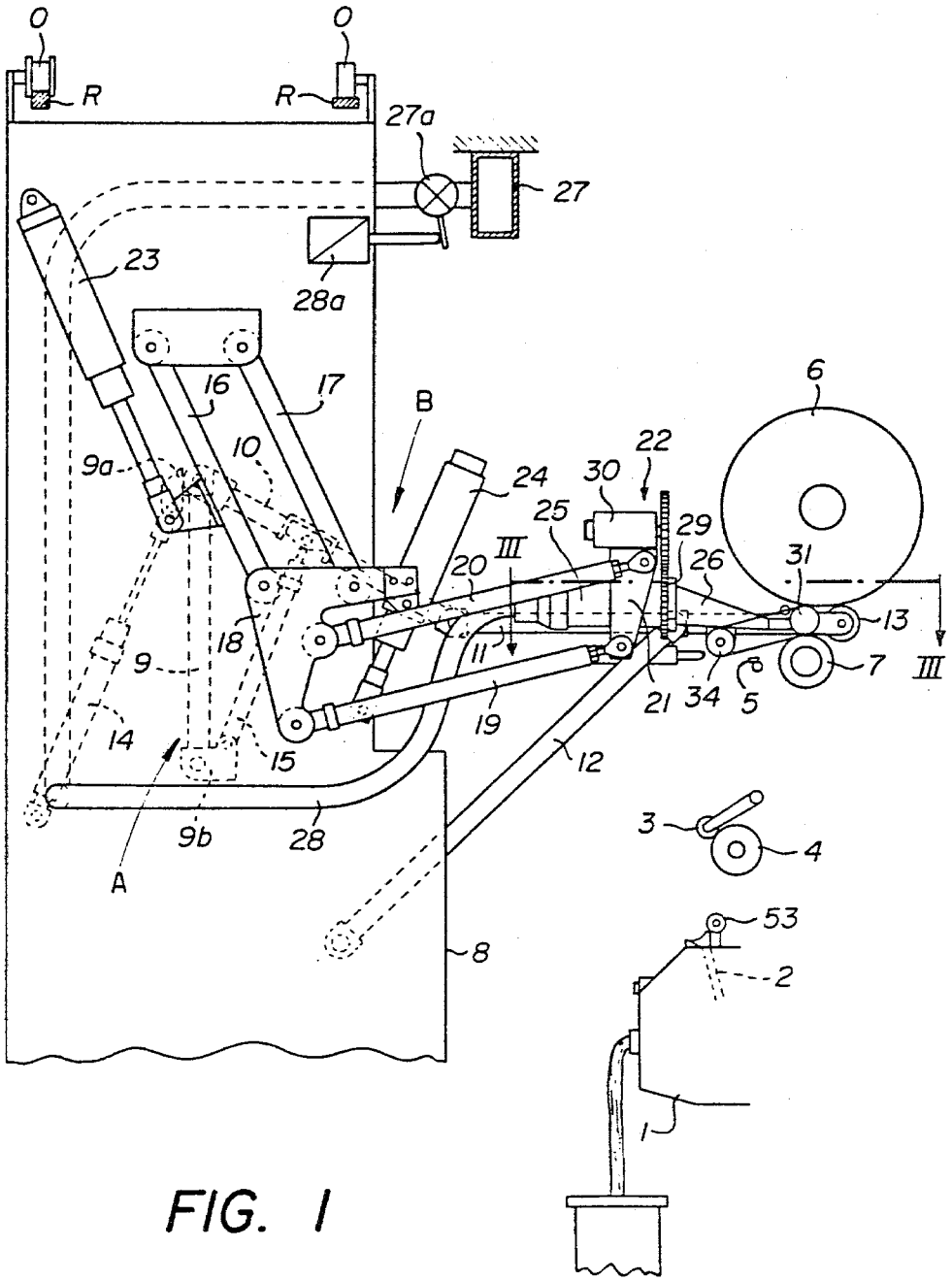
Figure 2:
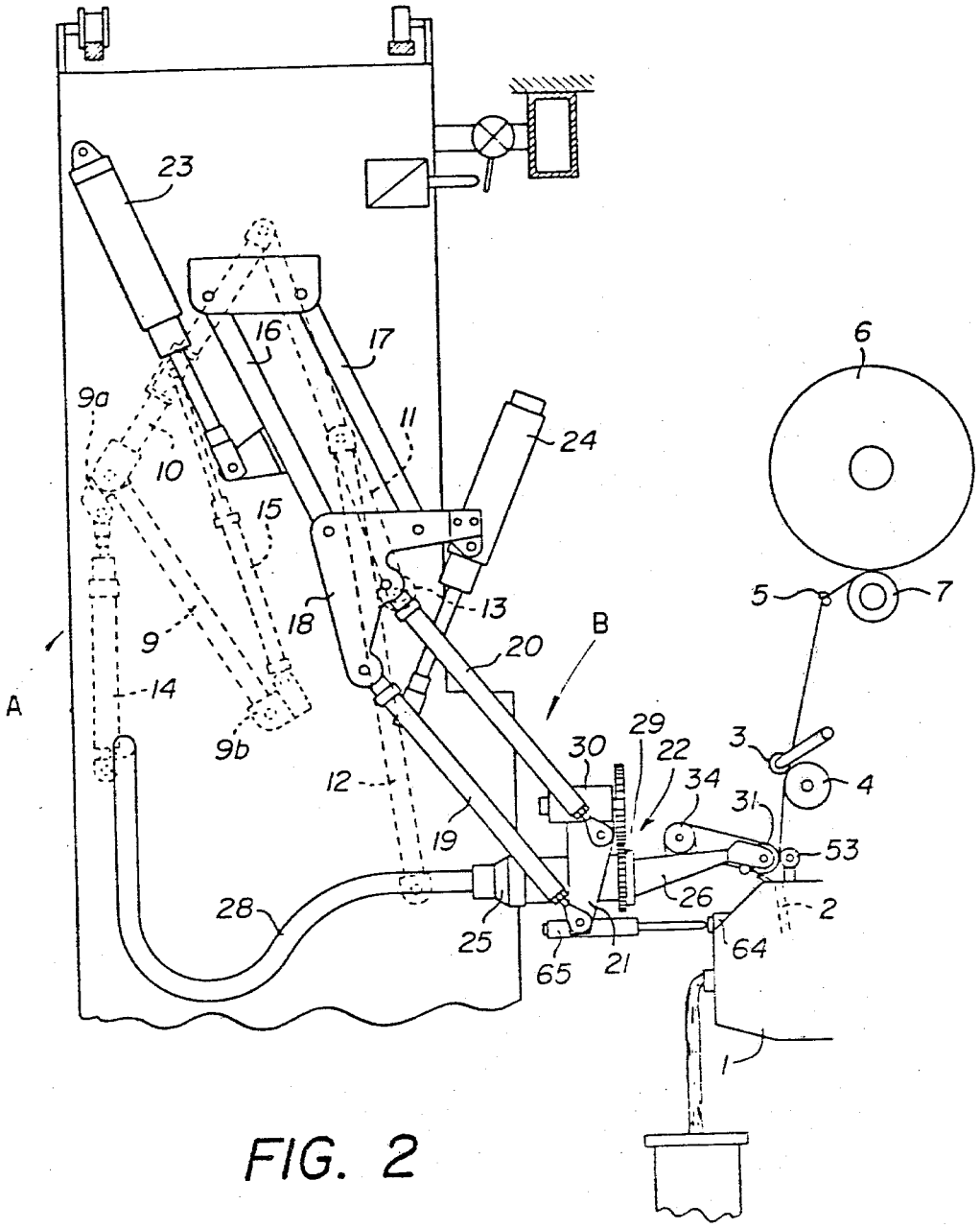

FIG. 1 shows some parts of a spinning unit of an open-end type spinning frame, these parts being necessary for the understanding of the invention. In particular, it shows a spinning device I with a pipe 2 for the exit of the yarn, rollers 3 and 4 to extract the yarn, traveller 5 intended to distribute the yarn on a cop 6, and the drive shaft 7 to drive cop 6. The re-attachment device comprises a casing 8 formed by 2 parallel plates; FIGS. 1 and 2 are represented with the front plate not shown.

The plates cover each other when the device is seen from the side, as in FIGS. 1 and 2.

The casing is mounted on a spinning frame by means of a guide rail R and by rolling organs O connected to said guide rail so that it can be conveyed in a programmed manner to the front of each spinning station.

The device comprises two separate systems of hinged arms. One group A includes four arms 9, 10, 11 and 12, of which two 10 and 11 are hinged together at one end. The arm 9 is hinged at one end to a part of the casing 8 and at the other to the free end of the arm 10, while the arm 12 is hinged at one end to the casing 8 and at the other to the middle of the arm 11. A small roller 13 is fitted to the end of arm 11 and is able to cooperate with a wedge 72 positioned frontally or to be replaced by the wedge.

This group is activated by two jacks 14 and 15, of which the jack 14 is hinged on the one hand to the casing 8 and on the other to an appendix 9*a* on the end of the arm 9 hinged to the arm 10, whereas the jack 15 is hinged to an appendix 9*b* at the other end of the arm 9 and to the middle of the arm 10. The whole of this articulated group is installed on the outer surface of the casing 8.

The other group B is positioned between the two parallel plates forming the casing 8 and consists of a double structure, which is symmetrical in respect of a vertical plane passing between the two parallel plates forming the casing 8. The two halves of the structure are coupled to each other kinematically.

Only one of these two structures can be seen in the side views of FIGS. 1 and 2.

This structure comprises a first pair of parallel arms 16 and 17, both hinged at one of their ends to an intermediate articulation plate 18, and a second pair of parallel arms 19 and 20 hinged at their two respective ends in such a way as to connect the articulation plate 18 to a support 21 of the re-attachment head 22.

A first jack 24 is fixed, on the one hand, to the intermediate plate 18 and is hinged, on the other hand, to the arm 19.

Figure 3:
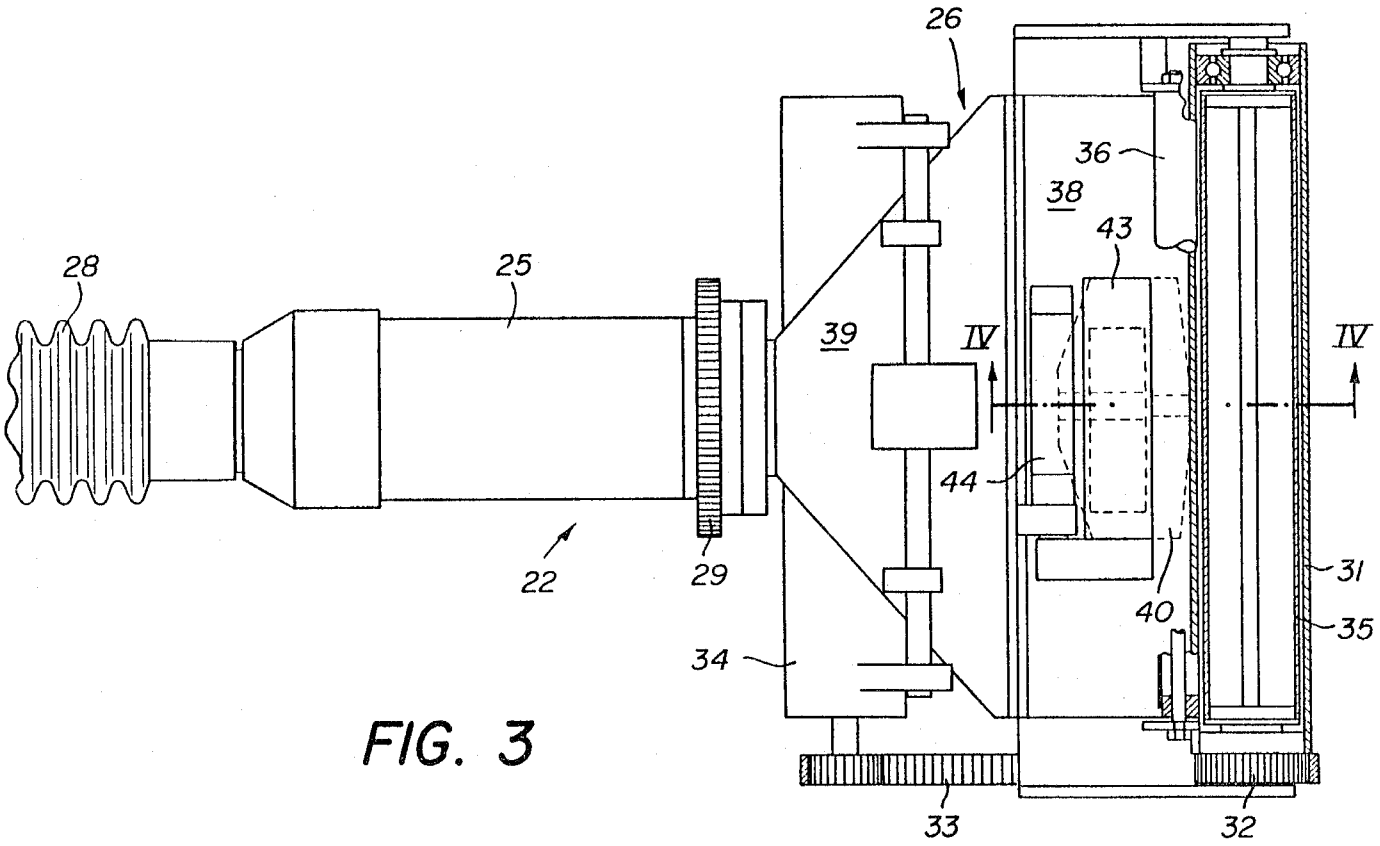

The re-attachment head 22 carries out almost all the functions required for the re-attachment except for the transfer between the cop 6 and the spinning device 1, the transfer being carried out by mechanism B of the hinged arms 16–20, except for the lifting of the cop 6, which is carried out by the articulated arms 9 and 12. The re-attachment head 22 is shown in greater detail in FIGS. 3, 4 and 5.

It comprises two parts 25 and 26, of which one, the rear part 25, consists of a tubular organ connected to a feed conduit 27 with a flexible hose 28 (FIGS. 1 and 2). The feed conduit 27, which stretches along the whole length of the spinning frame, is fed by a general source of suction (not shown here) for the spinning frame. The conduit 27 includes some openings located to coincide with each spinning station and controlled by valves 27*a* operated by an electromagnet 28*a* connected to the hose 28. The front part 26 is installed so as to rotate on the rear part 25 around the lengthwise axis of the tubular organ 25. A toothed ring 29 is solidly fixed to the front part 26 and is engaged in the pinion of a motor 30 (FIGS. 1 and 2) solidly fixed to the rear part 25 anchored to the support 21, and intended to make the front part 26 turn by 180° in respect of the rear part 25.

From a constructional point of view the front part 26 is flattened and enlarged progressively towards its front and has, fitted at its front end, a roller 31 the lengthwise axis of which extends crosswise to the lengthwise axis of the rear part 25 of the re-attachment head 22.

The roller 31 is fitted in such a way as to rotate around its lengthwise axis and bears at one of its ends a toothed wheel 32 connected by a transmission belt 33 to a drive motor 34. A semi-cylindrical shield 35 is fitted inside the roller 31.

A second roller 36 may be envisaged as being fitted in such a way as to rotate around a lengthwise axis parallel to that of the roller 31 and rests in elastic contact against the roller 31. The roller 31 is close to an elongated opening 37 (FIG. 4) located at the front end of the part 26. The opening 37 is situated in one of the ends of the passage 38, which has a rectangular cross section and constitutes the front end of the re-attachment head 22.

The opening 37 is connected to the tubular organ that forms the rear part 25 of the re-attachment head by means of a joint 39. The section of the joint 39 tends to become progressively circular so as to adapt itself to the end of the tubular organ of the rear part 25.

The passage 38 contains a guide and yarn-shearing mechanism that comprises a stationary element 40, through the middle of which there passes a guide channel 41 oriented according to the lengthwise axis of the re-attachment head 22. The channel 41 communicates with the channel 42 of the element 43, which is able to slide crosswise to the lengthwise axis of the re-attachment head 22 and is connected to a drive jack 44. Two small plates 45 and 46 made of a hard material are fixed respectively to the elements 40 and 43 of the guide and yarn-shearing mechanism and are lodged in unoccupied hollows in contact with the surfaces or faces adjacent to the elements 40 and 43 in the area of the guide channels 41 and 42.

As a result the sliding of the element 43 in respect of the element 40 causes the opposed mouths of the channels 41 and 42 to slide away from each other and the yarn passing through them to be sheared.

A second channel 42*a*, parallel to channel 42 (FIG. 5), is intended to be positioned as a elongation of channel 41 after the element 43 has been caused to slide by the jack 44.

A sideways channel 47 opens into channel 42*a* and is connected to a source of compressed air (not shown here) for the spinning frame. FIG. 6 shows the organ 48 to introduce the yarn, which is located at the outlet of the exit pipe for the yarn 2 and comprises a channel 49 positioned in the elongation of the opening of the pipe outlet 2.

The surface of organ 48 introducing the yarn consists of two portions of concave cylinders 51 and 52. The portion of the cylinder 52 is coaxial with a roller 53 installed on two supporting arms 54 so that it can rotate. The center of curvature of the portion of the cylinder 51 is occupied by the axis of the roller 31 and is shown in FIG. 2.

The groove 55 made in the organ 48 enables the yarn-feeler 56 of the spinning device 1 to oscillate around its vertical axis.

The electrical circuit of FIG. 8 shows the control of the feed for the rotor of the fibers and, in particular, the means which enable the yarn-feeler to be neutralized.

The electrical circuit contains in a known manner a reed-relay 57, which is activated by a permanent magnet 56*a* solidly fixed to the yarn-feeler 56 of a known type, of the spinning device 1. The reel-relay 57 is installed in series with a lamp that acts as a warning light 58, between two terminals of the source of the current. The lamp 58 is in parallel with a relay 59, a diode 60 and an electromagnetic coupling 61 of the mechanism feeding the turbine of the fibers. A bobbin 62 is fitted in series with a diode 63 and a switch 64. A diode is positioned between the coupling 61 and the switch 64.

The switch 64 is activated by a cylinder 65 solidly fixed to the support 21 (FIG. 2).

Figure 7:
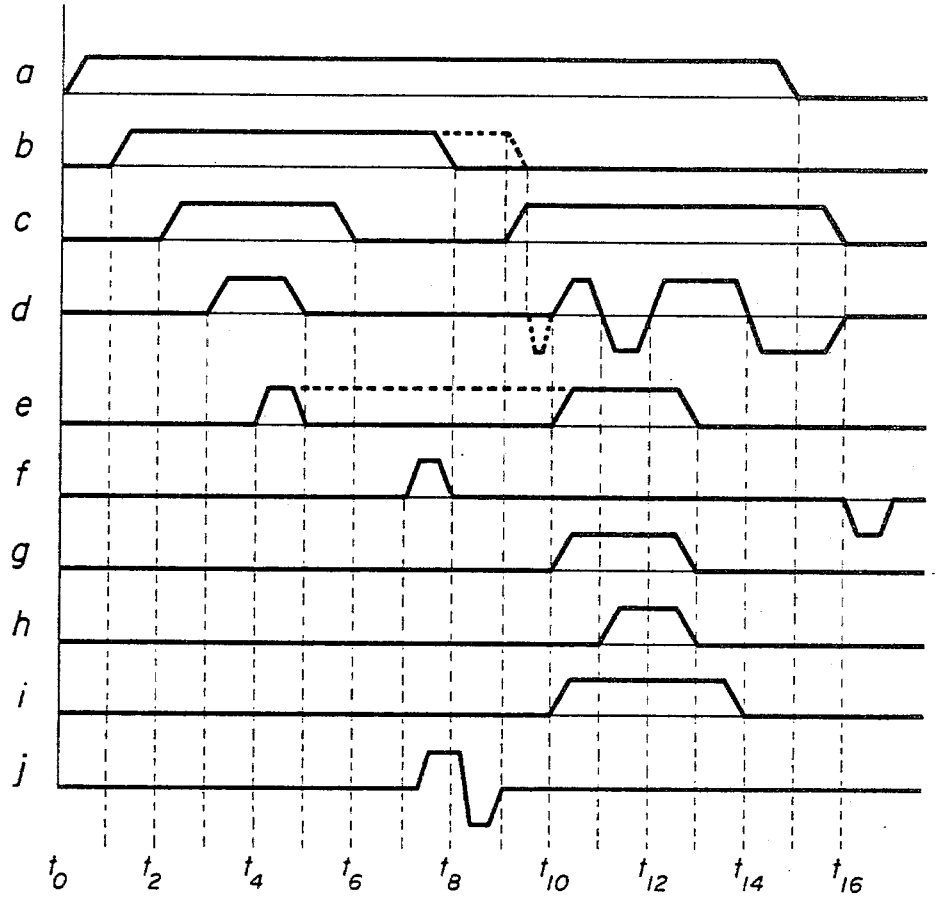
FIG. 7 shows graphs of the time variations between the different functions performed.

The variation in timing of the various functions is shown in the graphs of FIG. 7. The graphs of the various functions refer solely to the functions of the actual re-attachment.

The re-attachment operation is associated with an operation to clean the turbine, which is carried out at the same time by a device which is not described here because it is known from No. CH OS 5935/79. Moreover, the device and its method of working are not necessary for the understanding of this present invention.

The various functions of the device described have been indicated with letters running from "a" to "j" in FIG. 7 and each refer to one of the motor organs independently of the fact that the latter perform one or more different functions in the course of a cycle.

The function indicated with "a" at the instant t0 corresponds to the simultaneous activation of the jacks 14 and 15 from the retracted position of FIG. 2 to the extended position of FIG. 1. This last position, which is shown in FIG. 1, is held until the end of the re-attachment and corresponds to the deactivation of the contact or disengagement of the cop 6 from the drive shaft 7 owing to the action of the roller 13.

The function indicated with "b" at the instant t1 refers to the withdrawal of the piston of the jack 24, which takes back with it the arms 19 and 20.

The function "b" is followed at once at the instant t2 by the function indicated with "c", which refers to the extension of the shaft of the jack 23, which acts on the arms 16 and 17 so that the head 22 comes to the position shown in FIG. 1. The function indicated with "d" at the instant t3 corresponds to the start-up of the motor 34 with a direction of rotation suitable for moving the roller 31 in the direction of the unwinding of the cop 6.

At the instant t4 the function marked "e" corresponds to the opening of the valve 27*a* by the electromagnet 28*a* and therefore to aspirate through the hose 28 and the perforated roller 31. At the instant t5 the functions marked "b" and "e" stop at the same time.

The end of the yarn located on the periphery of the cop 6 has been aspirated by the air circulating through the hose 28 and the head 22, while the perforated roller 31 was making the cop 6 rotate in the direction of the unwinding of the yarn.

Now a certain part of the yarn is located in the hose 28 and is held tightly gripped between the roller 31 and the roller 36.

During the aspiration the yarn, which is wound in alternating spirals and thereafter with the opposite slope on the cop 6, is unwound with an alternating backwards and forwards movement from one edge of the cop 6 to the other. The yarn is taken into the passage 38 because of the anti-clockwise rotation of the perforated roller 31 (FIG. 4) and is sucked into the hose 28. In this way the yarn is stretched between the rollers 31 and 36 and its end is sucked away.

The alternating backwards and forwards movement leads the yarn automatically to be engaged in the guide channels 41 and 42 so that it is kept exactly in the middle of the length of the roller 31.

At the instant t6 the jack 23 withdraws and makes the head 22 go backwards in respect of the cop 6, which stays disengaged from the drive shaft 7 owing to the roller 13 located at the end of the arm 11.

At the instant t7 the motor 30 makes the front part 26 of the head 22 rotate by 180° in such a way that the yarn, held tightly between the rollers 31 and 36, penetrates into the opening 37 in the front end of the head 22 and turns about 180° around the roller 31.

At the end of the rotation of the front part 26 of the head 22 at the instant t8, the jack 24 moves from its retracted position to its extended position and takes with it the arms 19 and 20. At the instant t9 the jack 23 returns to its extended position, so that the head 22 is located in the position shown in FIG. 2.

The perforated roller 31 presses against the roller 53 (FIG. 6) so that the yarn is gripped between the rollers 31 and 53.

At the instant t10 four functions marked "d", "e", "g" and "i" all begin at the same time.

Function "g" corresponds to the operation carried out by the yarn-shearing element 43 owing to the jack 44, which moves the channel 42*a* so as to become the extension of the channel 41.

Function "d" corresponds to the start-up of the motor 34 in the direction of the unwinding of the yarn.

Function "e" corresponds to the suction which causes the sheared end of the yarn to penetrate through the channel 42*a*.

Function "i" corresponds to the closure of the switch 64 owing to the jack 65. Owing to the presence of the diodes 60 and 63 the closure of switch 64 (FIG. 8) causes the relay 59 to be fed, and the latter keeps the electromagnetic coupling 61 under tension and thus in a position of disengagement. It also causes the bobbin 62 to be put under tension, and the bobbin then causes the disengagement of the permanent magnet 56*a* and the opening of the reed-relay 57.

However, if the relay 59 stays under tension because of the closure of the switch 64, the opening of the reed-relay 57, instead, remains without any consequences in the electrical circuit.

That makes it possible to bring the yarn-feeler 56 into the spinning position just by acting on its permanent magnet without also feeding fibers to the spinning rotor. That enables the yarn to be introduced into the production pipe 2 of the spinning device without first having to move the yarn-feeler 56. The movement of yarn-feeler 56 would have been necessary if the yarn-feeler 56 had been in the position it usually occupies when the yarn is not at the outlet of the pipe 2.

At the instant t11 the conduit 47 is fed with compressed air at the same time as the direction of rotation is reversed for the motor 34, which pulls back the yarn it had itself previously introduced into the channel 42*a* when the yarn has been cut.

The jet of air also has the effect of opening the end of the yarn and eliminating the shortest fibers resulting from the shearing of the yarn.

At the instant t12 the yarn is gripped between the rollers 31 and 53. The direction of movement of the motor 34 is then reversed yet again, and the yarn is again unwound from the cop 6.

The rotation of the rotor of the spinning turbine causes suction to pass through the outlet pipe of the yarn 2 in such a way that the yarn thrust between the rollers 31 and 53 is guided through the cleft 51 in the pipe 2 and from there thereafter into the rotor (not shown). At the instant t13 when the motor 34 starts its reverse movement, the suction through the hose 28 is cut off (function marked "e"), the yarn-shearing element 43 is brought back into the position shown in FIG. 5 (function marked "g") and the jet of air through the conduit 47 is cut off (function marked "h").

At the instant t14 the direction of rotation of the motor 34 is again reversed (function marked "d") and at the same time the cylinder 65 releases the switch 64.

By opening, the switch 64 cuts off the feed to the bobbin 62 and to the bobbin of the relay 59 and at the same time frees the yarn-feeler 56 and the coupling 61. Some fibers are introduced into the turbine, where they meet the opened end of the yarn.

The yarn-feeler 56, being freed by the bobbin 62, finds the yarn stretched in such a way that the magnet 56*a* remains separated from the reed-relay 57. The reed-relay 57 does not close and therefore no longer feeds the relay 59 controlling the coupling.

As soon as the motor 34 has reached its normal speed, at the instant t15, the jacks 14 and 15 are brought back to their starting positions (function marked "a") so that the cop 6 rests on the drive shaft 7 and shaft 7 can provide motion for the cop 6 itself.

At the instant t16 two functions begin, namely the withdrawal of the piston of the jack 23, which takes back the head (function marked "c"), and the stopping of the motor 34 (function marked "d"). The yarn produced is extracted from the turbine by the rollers 31 and 53 and is held by the ring 5, which leads it from one edge to the other of the cop 6 and of the extraction rollers 3 and 4.

The edge of the roller 3 has a notch made in a known manner, so that when the yarn meets this notch it is engaged thereby and taken between the rollers 3 and 4. It is at this point that the roller 31 is withdrawn as the re-attachment has been ended.

The last operation (function marked "f") consists in making the part 26 of the head 22 rotate by 180° so as to put it in the starting position for the next re-attachment.

The device described has various characterizing details. In particular it should be noted that almost all the functions are carried out by the head 22 in such a way that the yarn undergoes no transfers, as happens instead in known devices. This particular feature leads to a lesser number of organs, some of which carry out manifold functions, as in the case of mechanism to guide and shear the yarn, the motor 34 and the roller 31 which serve to extract the yarn from the cop 6, to unwind a certain length of yarn, to cause the sheared end of the yarn to pass in front of a jet of air so as to open the end and eliminate the short fibers, to introduce the yarn into the turbine and then to pull it back until it has been extracted normally by the rollers 3 and 4.

The rotation of the front part 26 of the head 22 also constitutes an innovatory element of great interest since it enables the yarn to be made to pass around the lower half of the roller 31 and therefore to be gripped between the roller 31 and the roller 53. This makes it possible that, when the end of the yarn leaves the roller 31 and perhaps the roller 36 as well, the yarn is still stretched between the rollers 31 and 53 owing to the cleft 51 next to the roller 31 and undergoes the suction of the rotor. As a result of this, when the direction of rotation of the motor 34 is reversed, the end of the yarn penetrates of necessity into the rotor through the outlet pipe 2 for the yarn.

Another innovatory fact is the reliability of the functioning, which is linked directly to the simplicity of the device, the absence of the need for the yarn to be transferred from one organ to another and the fact that the yarn is gripped continuously between the roller 31 and, possibly, the roller 36.

This reliability is also correlated to the passage of the yarn being obtained from the rollers 31 and 36 to the rollers 31 and 53 by means of the rotation of the front part 26 and the displacement of the roller 31, which is brought into contact with the roller 53.

In one variant, which is not shown here, it is possible to consider the modification of the mechanism to guide and shear the yarn as shown in FIG. 5, by eliminating the small plates 45 and 46, the channel 42*a* and the conduit 47. In this variant the travel of the jack 44 will be shortened in such a way as to make the two channels 41 and 42 slide crosswise in respect of each other until their opposed edges meet so as to grip the yarn.

According to such a variant a part of the yarn is held by the rollers 31 and 36 in the hose 28, where the part is caught in the turbulence caused by the variations in section and direction of the part of the conduit which passes through the head 22. The turbulence breaks the strands in the yarn. Then a part of the yarn is pulled back from the conduit 28 by reversing the direction of rotation of the rollers 31 and 36, and the yarn is now caught between the opposed edges of the channels 41 and 42 in such a way that, by continuing to pull, the rollers 31 and 36 break the yarn with its strands and fibers torn, above all, by the turbulence of the air at the part located at the joint 39 of the head 22. The yarn is thus ready for re-attachment.

The variant of the head 22 shown in FIG. 9 includes a non-perforated roller 66, which replaces the perforated roller 31 and is connected to the drive motor 34 (FIGS. 1–2) in the same way as the perforated roller 31. The end of the passage 38 next to the roller 66 ends with a baffle 38*a* which, together with the roller 66, delimits an intake conduit 38*b*.

As in the preceding case, the guide channels 41 and 42, the method of working of which has already been described, are present. A second conduit 67 connected to the suction hose 28 (FIG. 11) by a flexible hose 68 ends with an elongated suction opening 69 next to the roller 66 and diametrically opposite, in respect of the roller 66, to the opening of the intake conduit 38*b*.

The face on which the suction opening opens has two surfaces which are symmetrical in respect of the lengthwise axis of the conduit 67 and form between them an angle smaller than 180° (FIG. 10). The angle is located to correspond with half of the length of the roller 66 and serves to align the yarn, as will be explained hereinafter.

The righthand section of the conduit 67 consists of a vertical opening intended to orient the aspirated coil of yarn so as to form a reserve of yarn available at the time of the actual re-attachment process, as will be explained hereinafter.

FIG. 12 shows a variant of the arm 11 intended to lift the cop 6. The variant consists essentially in the addition of a motor 70 which has a reversible direction of rotation and is connected to the roller 13 by a drive belt 71. A pallet 72, shaped like a cone and fixed to the arm 11, stretches forwards in front of the roller 13 and serves to facilitate the lifting of the cop 6 by introducing itself between the cop and the drive shaft 7.

The intermediate position of the shifting arm articulated on the re-attachment head 22 so as to facilitate understanding of the working of the device embodying the variations described before has been shown in FIG. 11. The explanation of its working will be done with reference to the diagram of FIG. 7, wherein the variations of the working are shown with dotted lines. Since a very detailed description of the working has already been given during the course of the example of the lay-out shown in FIGS. 1 to 8, hereinafter only the sequences different from those described before shall be described.

It should be noted at once that the suction through the hose 28 (function marked "e") is continuous from instant t4 to instant t13.

The piston of the cylinder 24 (function marked "b") stays in its retracted position up to the instant t9. Thus the device is located in the position shown in FIG. 11 from instant t6 to instant t9.

The function marked "j", which corresponds to the start-up of the drive motor 70 of the roller 13 so as to rotate in the direction of the unwinding of the yarn on the cop 6, starts soon after instant t7, which corresponds to the rotation of the front part of the head by 180°, so that the opening of the conduit **38*b* is to be found at this moment beneath the non-perforated roller 66. According to the unwinding of the yarn by the roller 13, the yarn is sucked into the hose 28 through the alignment channels 41 and 42. The direction of rotation of the motor 70 is then reversed so that a certain length of yarn is pulled out again from the hose 28 and wound onto the middle of the cop 6**. This centering of the yarn is useful because it eliminates every risk of the yarn becoming caught on the organs of the re-attachment device and because it keeps the yarn in the middle.

After the instant t9 and as soon as the head has moved from its position in FIG. 11 to that of FIG. 2 where the yarn is gripped (held) between the rollers 53 and 66 (the latter being equivalent to the roller 31 shown in FIG. 2), the motor 34 pulls the roller 66 in the direction in which the roller 66 pulls the yarn out from the channel 38 towards the cop 6. As this yarn now forms a coil because the cop 6 is not turning and as air is aspirated through the opening 69, the coil of yarn is sucked into the opening and is positioned in the conduit 67 of which the section is formed by a vertical opening, as said earlier. This coil of yarn is used as a reserve, and its length is chosen so that it can reach thereafter the middle of the spinning turbine without the necessity in rotating the cop 6, of which the inertia is strong.

The next operation is the same as that already described, so that it will be possible to refer to that part of the previous description.

In the electrical diagram of the spinning control as modified in FIG. 13 compared to that shown previously there are the following: the reed-relay 57, the permanent magnet **56*a* solidly fixed to the yarn-feeler, the electromagnetic coupling 61 of the mechanism feeding the turbine of the fibers, the warning light 58 and the bobbin 62 which causes the repelling of the magnet 56*a***.

It should be noted that in this modified electrical diagram the cylinder 65 borne by the head 22 to activate the switch 64 is replaced with a flash bulb 73 and the switch 64 is replaced with a phototransistor 74.

The reed-relay 57 is connected to a delay circuit 75 with two signals of clock through the line 76.

The output of this delay circuit 75 is connected to a flip-flop (bistable multivibrator) 77 the output of which is connected on one side to the base of the transistor 78 controlling the coupling 61 and on the other side to a second delay circuit 79 which controls the bobbin 62 through a transistor 80.

The activation of the reed-relay 57 when the breakage of the yarn halts the coupling 61 is brought about with a delay of some seconds to make it possible to proceed with the cleaning, as described in Pat. No. CH OS 5935/79. At the instant t14 when the flash stimulates the transistor 74, the bistable multivibrator 77 commutes and puts the coupling 61 back into operation. The delay circuit 79 serves to delay by a few tenths of a second the stopping of the stimulation of the bobbin 62 that repels the magnet 21, the purpose being to prevent the yarn-feeler 56 (FIG. 6) from resting against the yarn before the re-attachment process is fully ended.

There are described here two preferential solutions, but variants are possible for a technician in this field. Thus the proportions and sizes can be varied, and it is possible to add, remove, replace or integrate parts or elements of parts, and so on. These and other variants are all possible within the scope of the invention.

I claim:

1. Re-attachment device for an open-end type spinning frame, comprising:

means to lift a cop from its drive shaft, means to drive the movement of said cop in the direction in which it is unwound, a suction conduit having an inlet to remove and aspirate the end of the yarn from the periphery of said cop, a first perforated roller next to said conduit installed coaxially with an axis crosswise to the inlet end of said conduit, an outlet pipe for the yarn coming from a spinning unit, means to transfer the yarn between said cop and said outlet pipe, an organ to shear the yarn, a drive organ, said first perforated roller and a second roller connected to said drive organ, said drive organ having a reversible direction so as to introduce the yarn into a rotor through said outlet pipe for the yarn and then to pull it back again as soon as it is re-attached;

a third roller fitted so as to rotate near to the outlet of the aforesaid pipe;

said second roller cooperating with said first roller positioned next to said suction conduit and associated with said drive organ;

a portion of said suction conduit next to said first roller being installed so as to rotate around the lengthwise axis of said conduit;

a positioning organ connected to said portion of the suction conduit serving to position it between two angular positions located 180° from each other;

said organ to shear the yarn being installed within said suction conduit; and a part of the suction conduit next to its rotating portion solidly fixed to said transfer means enabling movement of said first perforated roller from a first position next to the cop in one angular position of said rotating portion to a second position next to said third roller installed near the outlet of the outlet pipe of the yarn in the other angular position of said rotating portion.

2. Device as in claim 1, wherein the shearing organ includes a first stationary element equipped with a guide channel located in an operational manner according to the lengthwise axis of said conduit, a second element positioned next to said first element and installed crosswise to said lengthwise axis, equipped with a guide channel parallel to said lengthwise axis, and a drive organ to move said second element from a position wherein said channels form an extension of each other to a position in which they are staggered in respect of each other by a sliding movement.

3. Device as in claim 2, wherein said channels have corners at the ends thereof defining cutting edges and that the travel of said second element has been chosen so that the sliding movement between said channels is at least equal to their diameters.

4. Device according to claim 2, wherein the travel of said second element has been chosen so that the opposite edges of said channels come into contact frontally so as to grip the yarn between time.

5. Device according to claim 2, including a secondary portion of said suction conduit positioned parallel to said rotating portion of said suction conduit, said secondary and rotating portions having inlet openings, channel means for aligning the yarn, whereby the inlet openings of these two portions of the suction conduit are adjacent to two zones spaced at an angle from the periphery of a fifth roller adjacent to said suction conduit, and whereby the inlet opening of said rotating portion is adjacent to the cop in one of said angular positions, whereas the intake opening of said secondary portion is adjacent to the yarn stretched between the cop and said rotating portion in the other of the two angular positions and in the second position of said fifth roller.

6. The device according to claim 5, wherein said fifth roller adjacent to said suction conduit is in the second position and is adjacent to said third roller installed close to the outlet of the outlet pipe of the yarn, said fifth roller adjacent to the suction conduit is rotatable so as to pull back a given length of yarn from the rotating portion of the suction conduit in order to introduce a reserve of yarn into said secondary portion of said conduit located between said third and fifth rollers adjacent to each other and the cop, and the yarn is shearable in the rotating portion of the suction conduit.

7. Device according to claim 1, including two motor organs and wherein said transfer means include two parallelograms that can be deformed, of which one comprises a stationary part, its opposite part being integral with one of the parts of the other parallelogram, whereby each of said parallelograms is associated with a different one of said motor organs.

8. Device according to claim 1, including an organ located next to the outlet pipe of the yarn to guide the yarn, whereby said guiding organ is delimited in its upper part by a first semi-cylindrical surface next to said third roller mounted close to the outlet of the outlet pipe of the yarn and by a second semi-cylindrical surface next to said first perforated roller in the second of the positions of said first perforated roller.

9. Device according to claim 1, wherein the means to raise the cop from its shaft comprises an arm, drive means, and a guide so as to define a trajectory of said arm between the cop and said shaft, an end of said arm bearing a fourth roller, the axis of which is parallel to those of said cop and said shaft and includes a pallet shaped like a cone and a drive organ with two directions of rotation associated with said fourth roller and said arm stretches forward axially beyond said fourth roller to said pallet.

10. The device according to claim 9, wherein said fifth roller adjacent to said suction conduit is movable into a position intermediate said first and second positions, and that initially said fourth roller associated with the means to lift the cop is driveable in the direction of the unwinding of the yarn so as to provide a given length of yarn to said channel means centering the yarn in the rotating portion of the suction conduit and that said fifth roller then is driveable in the direction of the unwinding of the yarn so as to pull back from said centering channel means a part of the length of yarn introduced previously and to form a winding on the middle of the cop.

* * * * *